US012127677B2

(12) United States Patent
Lei

(10) Patent No.: US 12,127,677 B2
(45) Date of Patent: Oct. 29, 2024

(54) BED FRAME

(71) Applicant: US Clivia Trading Inc., Alhambra (CA)

(72) Inventor: Qinghu Lei, Alhambra, CA (US)

(73) Assignee: US Clivia Trading Inc., Alhambra (CA)

( * ) Notice: Subject to any disclaimer, the term of this patent is extended or adjusted under 35 U.S.C. 154(b) by 377 days.

(21) Appl. No.: 17/736,474

(22) Filed: May 4, 2022

(65) Prior Publication Data

US 2023/0355001 A1 Nov. 9, 2023

(51) Int. Cl.
*A47C 19/00* (2006.01)
*A47C 19/02* (2006.01)

(52) U.S. Cl.
CPC ..... *A47C 19/025* (2013.01)

(58) Field of Classification Search
CPC ..... A47C 19/00; A47C 19/02; A47C 19/021; A47C 19/025; A47C 19/005
See application file for complete search history.

(56) References Cited

U.S. PATENT DOCUMENTS 6,625,827 B1 * 9/2003 Polevoy ..... A47C 19/02 5/305
6,966,085 B1 * 11/2005 Cretsinger ..... A47C 23/002 5/249
11,457,747 B2 * 10/2022 Hong ..... F16B 12/54
2014/0338125 A1 * 11/2014 Polevoy ..... A47C 19/005 5/400
2018/0372138 A1 * 12/2018 Li ..... A47C 19/20
2020/0375367 A1 * 12/2020 Qiu ..... A47C 19/005

* cited by examiner

*Primary Examiner* — Fredrick C Conley
(74) *Attorney, Agent, or Firm* — Clement Cheng

(57) ABSTRACT

A bed frame has a first horizontal frame member and a second horizontal frame member formed parallel to the first horizontal frame member. A crossbeam extends from the first horizontal frame member to the second horizontal frame member. The crossbeam is inserted into the first horizontal frame member and the second horizontal frame member and is retained using a plug. A mounting aperture formed on the first horizontal frame member receives the crossbeam. The mounting aperture has a wide portion above a narrow portion. The wide portion includes a plug area. The narrow portion includes a crossbeam area, which receives the crossbeam. The plug area receives the plug.

9 Claims, 8 Drawing Sheets

BED FRAME

FIELD OF THE INVENTION

The present invention is in the field of bed frames.

DISCUSSION OF RELATED ART

Bed frames typically have horizontal and vertical members that support mattresses. After installation of a mattress on a bed frame, a user can cover the mattress with bedsheets and sleep on the bed sheets.

SUMMARY OF THE INVENTION

A bed frame has a first horizontal frame member and a second horizontal frame member formed parallel to the first horizontal frame member. A crossbeam extends from the first horizontal frame member to the second horizontal frame member. The crossbeam is inserted into the first horizontal frame member and the second horizontal frame member and is retained using a plug. A mounting aperture formed on the first horizontal frame member receives the crossbeam. The mounting aperture has a wide portion above a narrow portion. The wide portion includes a plug area. The narrow portion includes a crossbeam area, which receives the crossbeam. The plug area receives the plug.

The wide portion extends to a left or right side of the crossbeam area. The plug further includes a body insert having a rear panel opening formed as a general through the body insert. The body insert is made of an elastomeric material. The body insert further includes a body insert sloped upper side wall. The sloped upper side wall further includes a body insert protrusion. The body insert protrusion further includes a body insert protrusion engaging edge facing a front frame of the body insert to form a body insert flat upper wall for forming a front frame upper notch. The front frame upper notch receives the horizontal frame member.

The plug further includes a body insert. The body insert protrudes into the first horizontal frame member. The body insert further includes a downwardly extending side panel. The downwardly extending side panel has a side panel rear edge. The side panel rear edge also inserts into the first horizontal frame member, and the body insert forms a body insert lower wall that engages the crossbeam. The body insert forms a body insert flat upper wall that engages the first horizontal frame member. The downwardly extending side panel further includes a downwardly extending side panel inside wall that engages the crossbeam.

The plug has a body insert that has a horizontal sloped section. The horizontal slope section further has a first flexible section and a second flexible section adjacent to the first flexible section. The first flexible section and the second flexible section bend downwardly when the plug is inserted into the horizontal frame member. The horizontal frame member rides over a body insert protrusion to engage with a body insert flat upper wall and a body insert protrusion engaging edge. The mounting aperture has a mounting aperture lower protrusion that inserts into and engages a lower opening of the crossbeam to lock the crossbeam in place.

Figure 1:
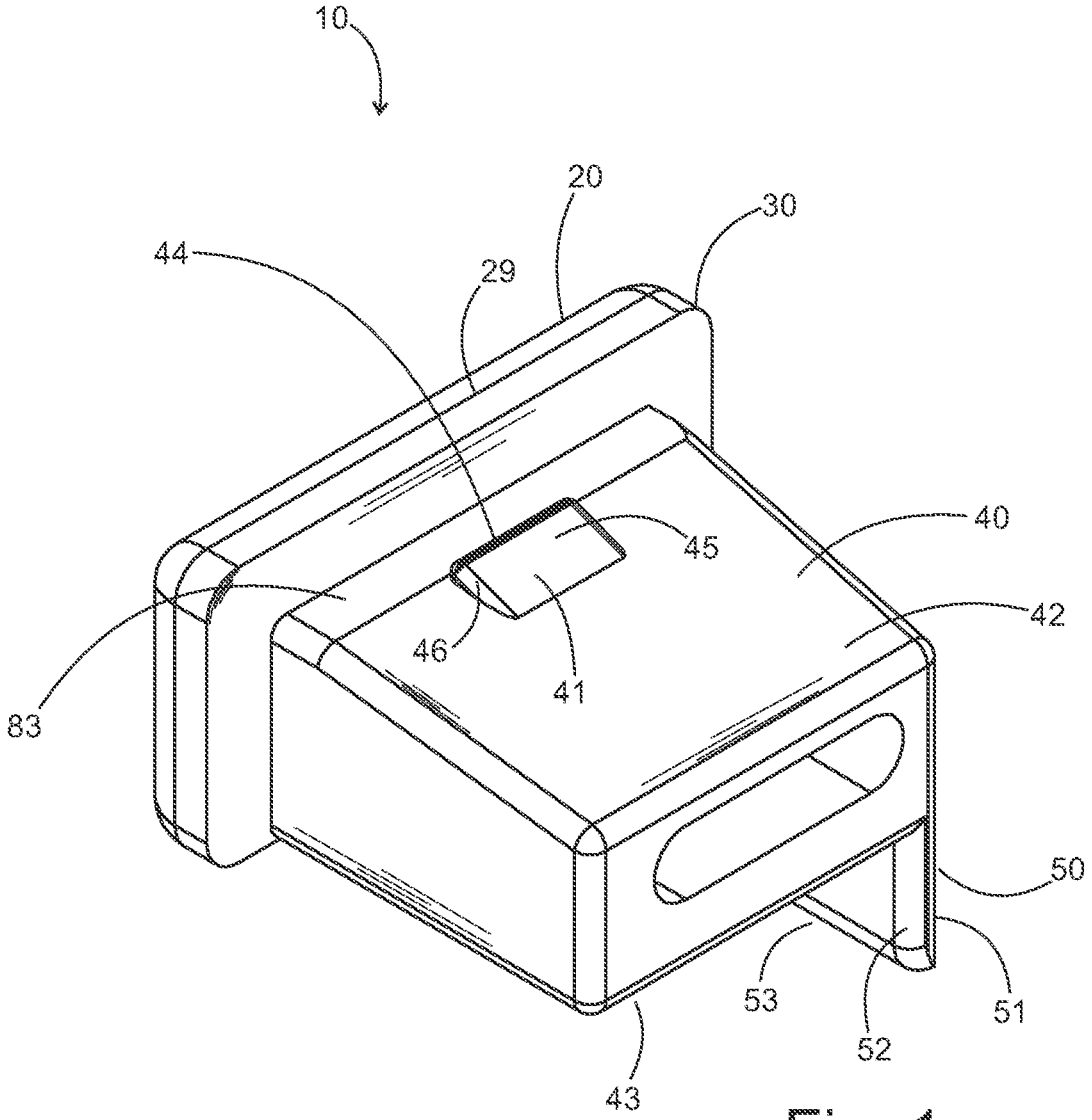
FIG. 1 is a rear perspective view of a plug.

The following call out list of elements can be a useful guide in referencing the element numbers of the drawings.

10 plug
20 front panel
21 front panel upper rounded edge
22 front panel right rounded edge
23 front panel left rounded edge
24 front panel lower edge
25 front panel lower extension right rounded edge
26 front panel lower extension lower rounded edge
27 front panel inside corner
28 front panel front face
29 front panel interface
30 front frame
31 front frame rear face
32 front frame lower extension
33 front frame upper notch
34 front frame left section
35 front frame right section
40 body insert
41 body insert protrusion
42 body insert sloped upper wall
43 body insert lower wall
44 body insert protrusion engaging edge
45 body insert protrusion catch face
46 wedge profile
47 first flexible section
49 horizontal sloped section
48 second flexible section
50 downwardly extending side panel
51 side panel rear edge
52 side panel rear edge bevel
54 downwardly extending side panel outside wall
55 downwardly extending side panel inside wall
56 vertical sloped section
70 horizontal frame member
71 horizontal frame member inside side wall
73 first horizontal frame member
74 second horizontal frame member
80 crossbeam
81 crossbeam upper surface
82 mounting aperture
83 body insert flat upper wall
84 wide portion
85 narrow portion
86 lower left channel
87 lower right channel
88 plug area
89 crossbeam area
90 rear panel
91 rear panel opening
92 rear panel opening edge
93 lower crossbeam opening
94 mounting aperture lower protrusion
95 lower crossbeam opening engaging edge
96 mounting aperture lower protrusion engaging edge

DETAILED DESCRIPTION OF THE PREFERRED EMBODIMENT

Figure 9:
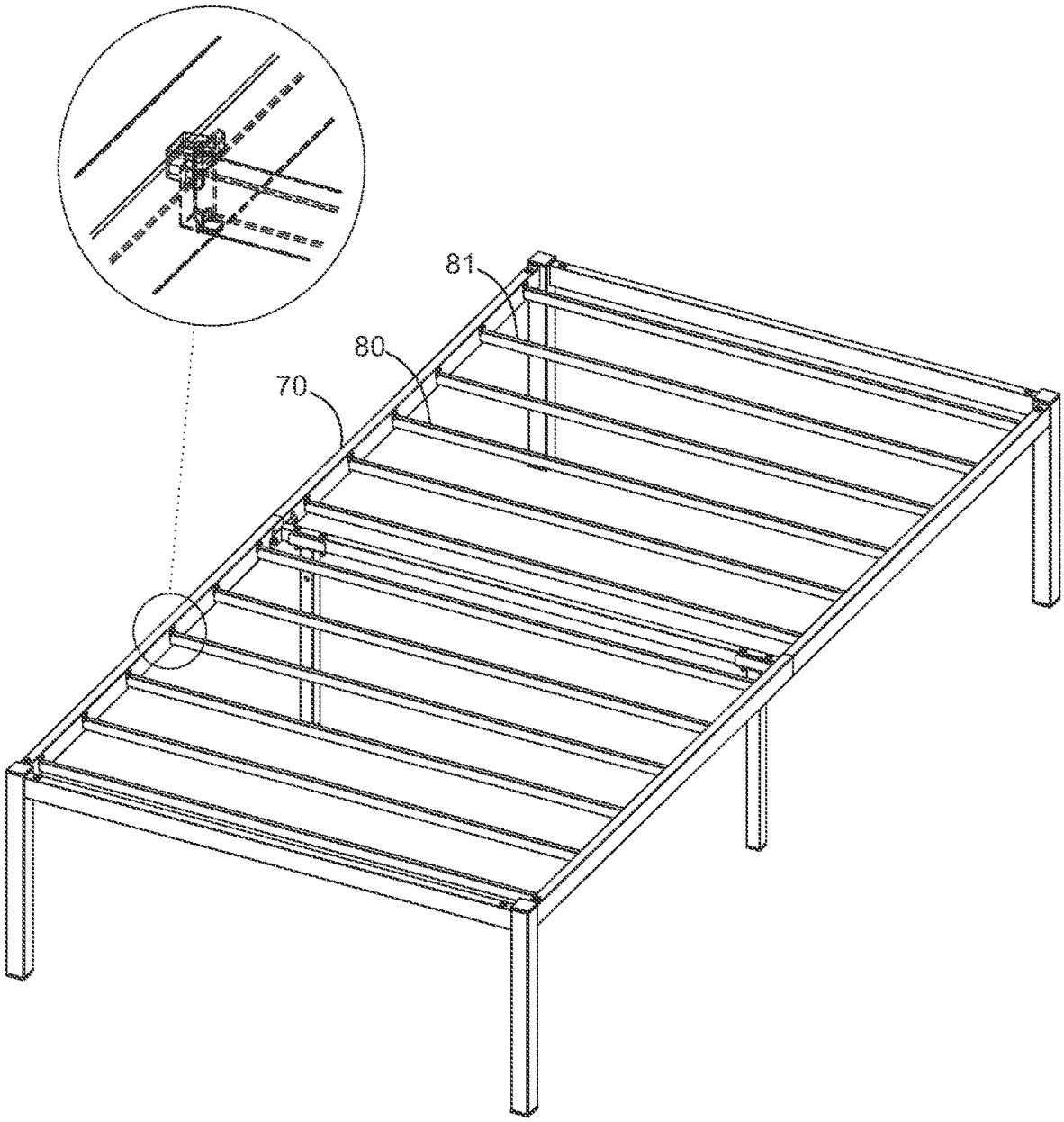
FIG. 9 is a diagram showing installation of the plug to secure a crossbeam.

A bed frame as seen in FIG. 9 has a pair of horizontal frame members 70 with crossbeams 80 extending across the horizontal frame numbers 70. The crossbeams 80 fit into mounting apertures 82 formed on an inside surface of the horizontal frame members 70. Each of the horizontal frame members 70 will have mounting apertures 82 formed on them so that the crossbeams 80 extend across the bed frame from a first horizontal frame member 73 to a second horizontal frame member 74. The first horizontal frame members 73 can have twelve mounting apertures for twelve left ends of twelve crossbeams 80. The crossbeams may flex slightly to allow the bed frame to retain and support a mattress or mattress foundation.

As seen in FIG. 1, a plug 10 fits into the mounting aperture 82 above a crossbeam 80 after a crossbeam 80 is inserted into a horizontal frame member 70 at a mounting aperture 82. The plug 10 has a body insert 40 with a channel through it. The body insert is preferably made of an elastomeric or flexible material such as high density polyethylene. The body insert 40 is attached to or integrally formed with a front frame 30 which may be attached to a front panel 20. The body insert 40 has a body insert sloped upper wall 42 which has a body insert protrusion 41 formed as a wedge catch. The body insert protrusion 41 preferably has a wedge profile 46 and terminates at a body protrusion engaging edge 44. The body protrusion engaging edge 44 retains to a horizontal frame member 70 at a mounting aperture 82 formed on the horizontal frame member 70. The horizontal frame member 70 has a side wall with a thickness that is sized to be received at the body insert flat upper wall 83.

The body insert 40 can be formed with a hollow passage through the body insert 40. The body insert sloped upper wall 42 has a downwardly extending side panel 50 extending downwardly from one edge of it. The downwardly extending side panel 50 has a side panel rear edge 51 that can be beveled with a side panel rear edge bevel 52. Additionally, the downwardly extending side panel 50 can have a side panel lower edge 53 that is also beveled for easy insertion into the mounting aperture 82. The body insert lower wall 43 engages the upper surface of the crossbeam 80 and wedges between the crossbeam 80 and the horizontal frame member 70.

The front panel 20 has a front panel interface 29 that fits with the front frame 30. The front frame can be integrally formed with the body insert 40. The wedge profile 46 can also be formed as an elastomeric material extending upwardly from the body insert 40 at the body insert protrusion 41. The body insert protrusion catch face 45 is a flat ramp that receives the horizontal frame member 70 at the mounting aperture 82. When the plug 10 is being pressed into the horizontal frame member 70, the body insert protrusion 41 biases the body insert 40 to a compressed position. The body insert 40 is preferably hollow. The body insert sloped upper wall 42 can have an angle that is similar to the angle of the wedge profile 46. The body insert sloped upper wall 42 allows easy insertion of the plug 10 into the horizontal frame member 70.

Figure 2:
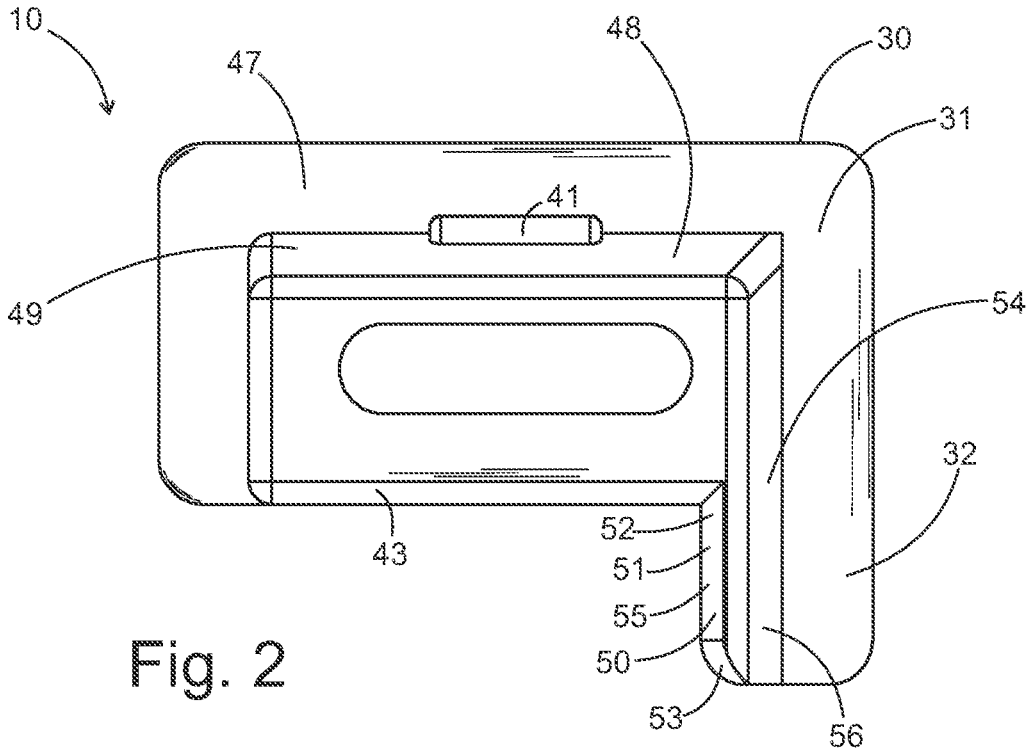
FIG. 2 is a rear view of a plug.

As seen in FIG. 2, the flexing of the body insert 40 can occur at a first flexible section 47 and a second flexible section 48 on the body insert flat upper wall 83. The first flexible section 47 and the second flexible section 48 are on either sides of the body insert protrusion 41. The horizontal sloped section 49 extends upwardly from the rear to the front of the body insert 40. The front frame 30 has a front frame rear face 31 that presses to a flush position with the horizontal frame members 70. The front frame rear face extends downwardly. The front frame 30 also extends downwardly to a front frame lower extension 32. The front frame lower extension 32 meets with a vertical slope section 56 of the downwardly extending side wall panel 54. Similarly, a downwardly extending side wall panel inside wall extends downwardly from the front frame 30 from a corner of the front frame rear face 30.

Figure 3:
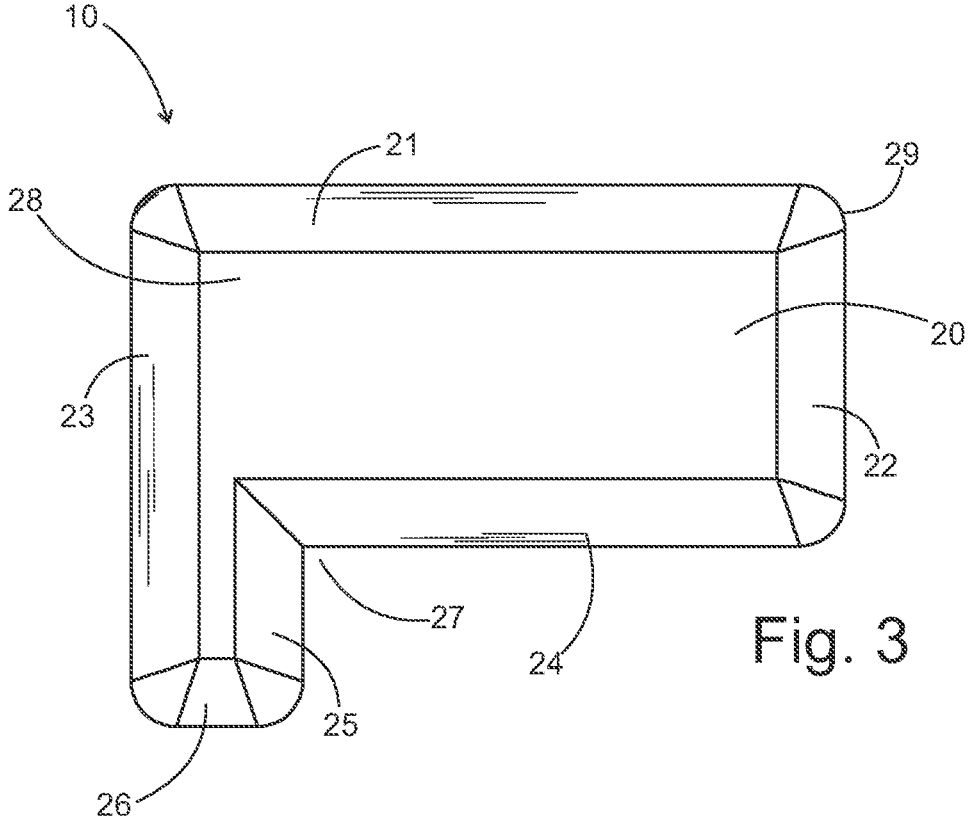
FIG. 3 is a front view of a plug.

As seen in FIG. 3, the front panel front face 28 is preferably a flat plane that is parallel to the external surface of the front frame 30. The front panel 28 has a front panel upper rounded edge 21 at a front upper portion of the front panel 28. The front panel 28 also has a front panel right rounded edge 22 at a right portion of the front panel 28, a front panel lower rounded edge 24 at a lower portion of the front panel 28, and a front panel left rounded edge 23 at a left portion of the front panel 28. The front panel lower extension right rounded edge 25 extends downwardly from the front panel 28. The front panel lower extension lower rounded edge 26 extends between the front panel lower extension right rounded edge 25 and the front panel left rounded edge 23. The rounded edges cooperate to retain the plug 10 to the horizontal frame members 70.

Figure 4:
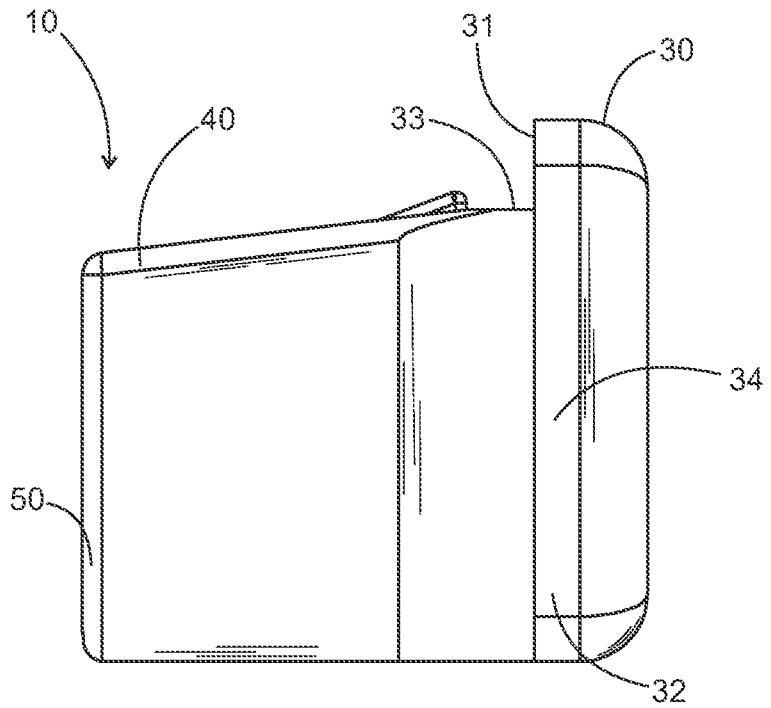
FIG. 4 is a left side view of a plug.

As seen in FIG. 4, the front frame upper notch 33 is formed at the body insert flat upper wall 83 which is defined between the body insert protrusion engaging edge 44 and the front frame rear face 31. The front frame 30 has a front frame left section 34 that is a flat portion which extends between the front panel left rounded edge 23 and the front frame rear face 31.

Figure 5:
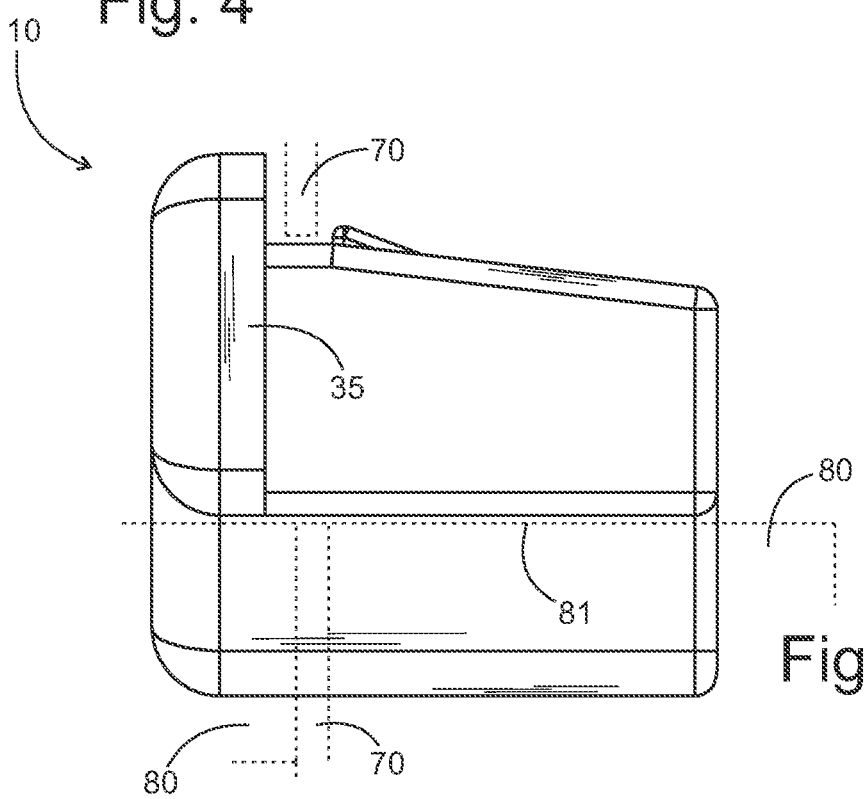
FIG. 5 is a right side view of a plug.

As seen in FIG. 5, the horizontal frame members 70 fits to the plug 10. The front frame right section 35 can be formed as a flat, normal, and perpendicular portion of the front frame 30 such that it extends between the front frame rear face 31 and the front panel right rounded edge 22. The crossbeam 80 has a crossbeam upper surface 81 that engages the body insert lower wall 43 and the downwardly extending side panel inside wall 55.

Figure 6:
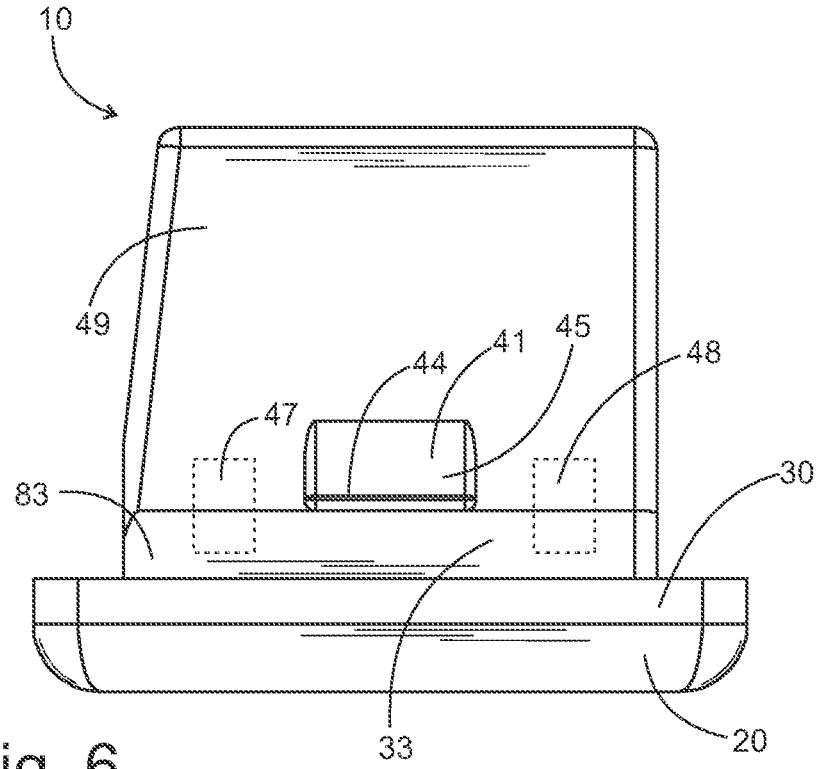
FIG. 6 is a top view of a plug.
Figure 7:
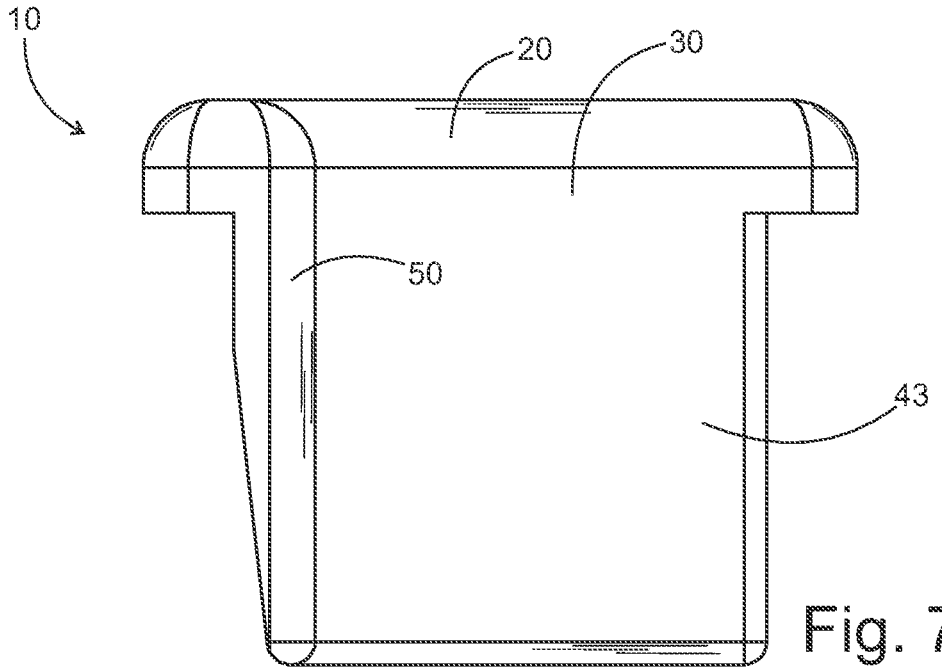
FIG. 7 is a bottom view of a plug.
Figure 8:
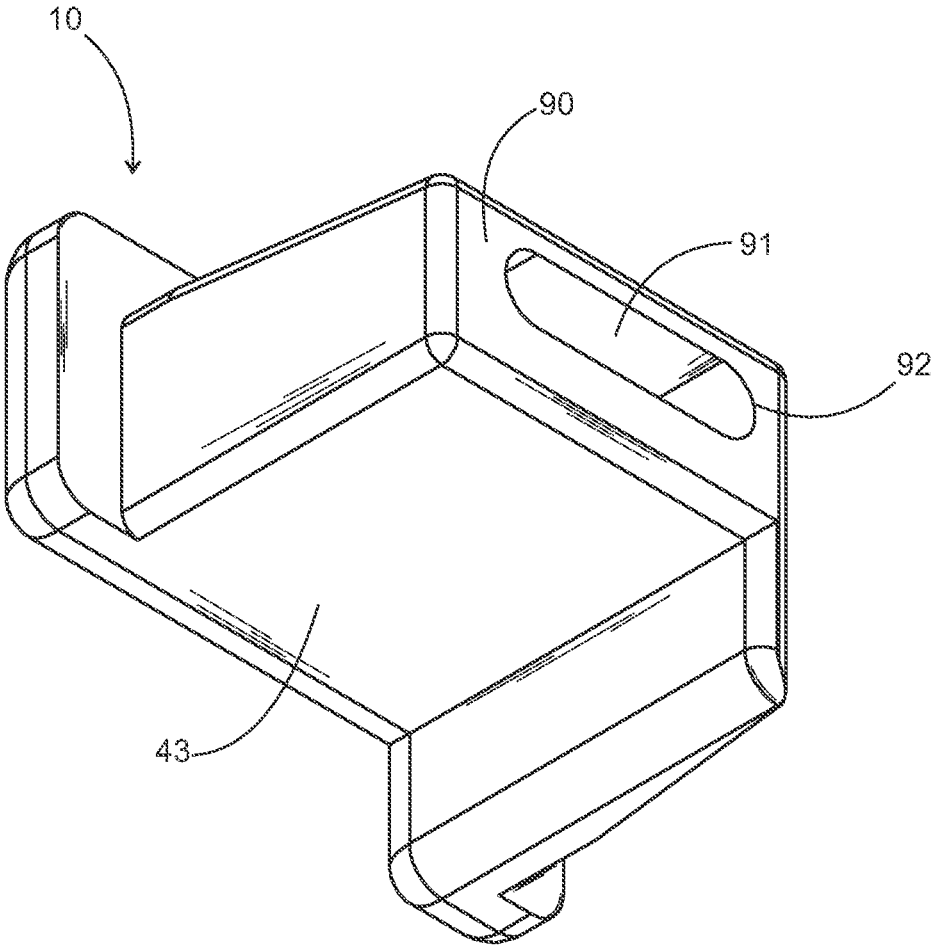
FIG. 8 is a rear perspective view of a plug.

As seen in FIGS. 6 and 7, the plug has a first flexible section 47 and a second flexible section 48 that are generally rectangular in shape and formed on the horizontal slope section 49 and the body insert flat upper wall 83. As seen in FIG. 8, the rear panel 90 has a rear panel opening 91 at a rear panel opening edge 92. The rear panel opening 91 preferably forms a channel through the body insert 40 and optionally up through the front frame 30. The front panel 20 may cover the rear panel opening 91 formed through the front frame 30.

Figure 10:
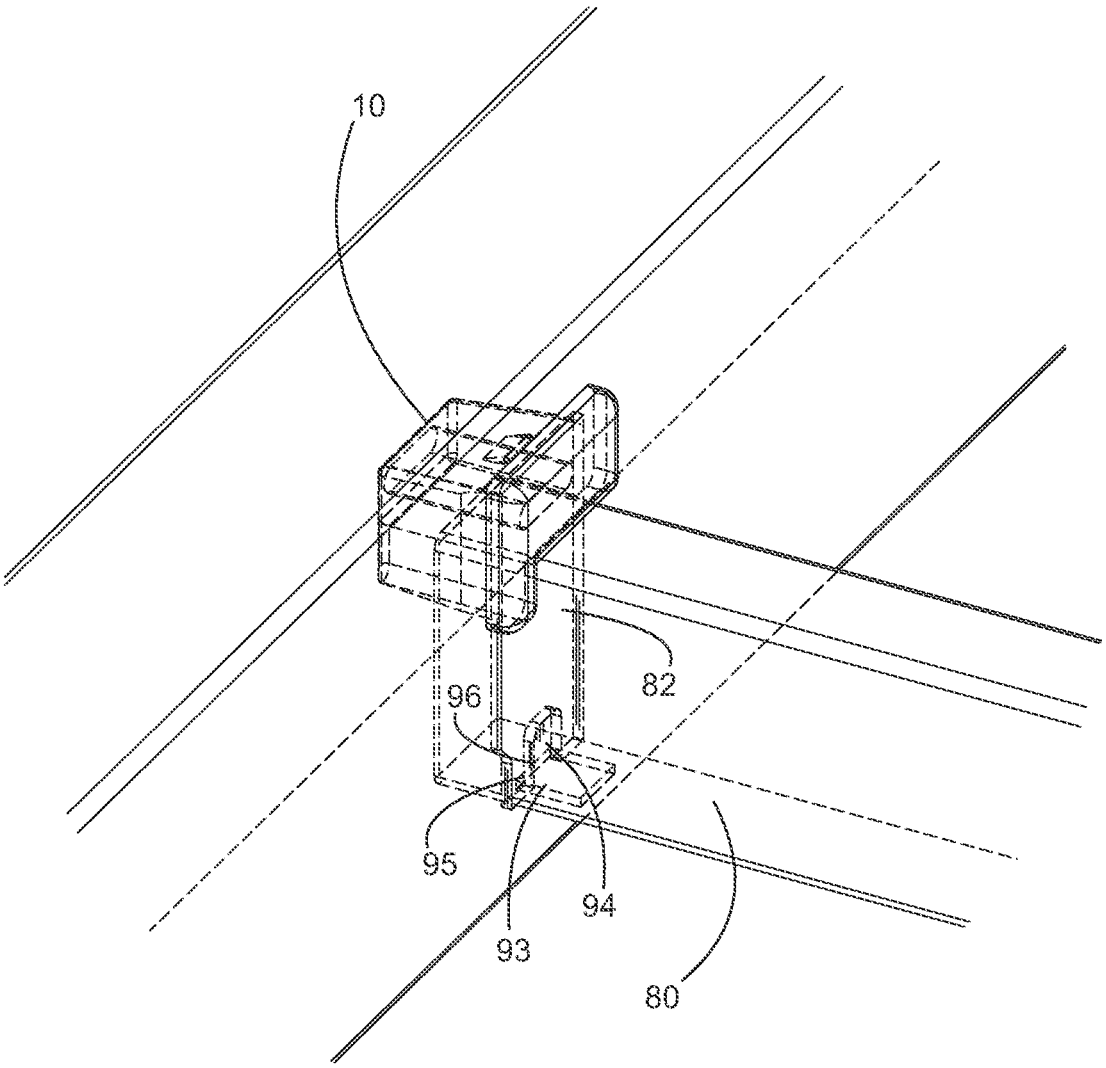
FIG. 10 is a close-up diagram of FIG. 9.

As seen in FIGS. 9-10, the horizontal frame members 70 may include a first horizontal frame member 73 and a second horizontal frame member 74. The first horizontal frame member 73 and the second horizontal frame member 74 can be perpendicular to each other with crossbeams 80 extending between them into opposing mounting apertures. The lower crossbeam opening 93 formed on the mounting aperture 82 receives the mounting aperture lower protrusion 94 formed on the crossbeam 80. The lower crossbeam opening 93 is preferably formed as a square or rectangular opening having a lower crossbeam opening engaging edge 95 that engages the mounting aperture lower protrusion engaging edge 96.

Figure 11:
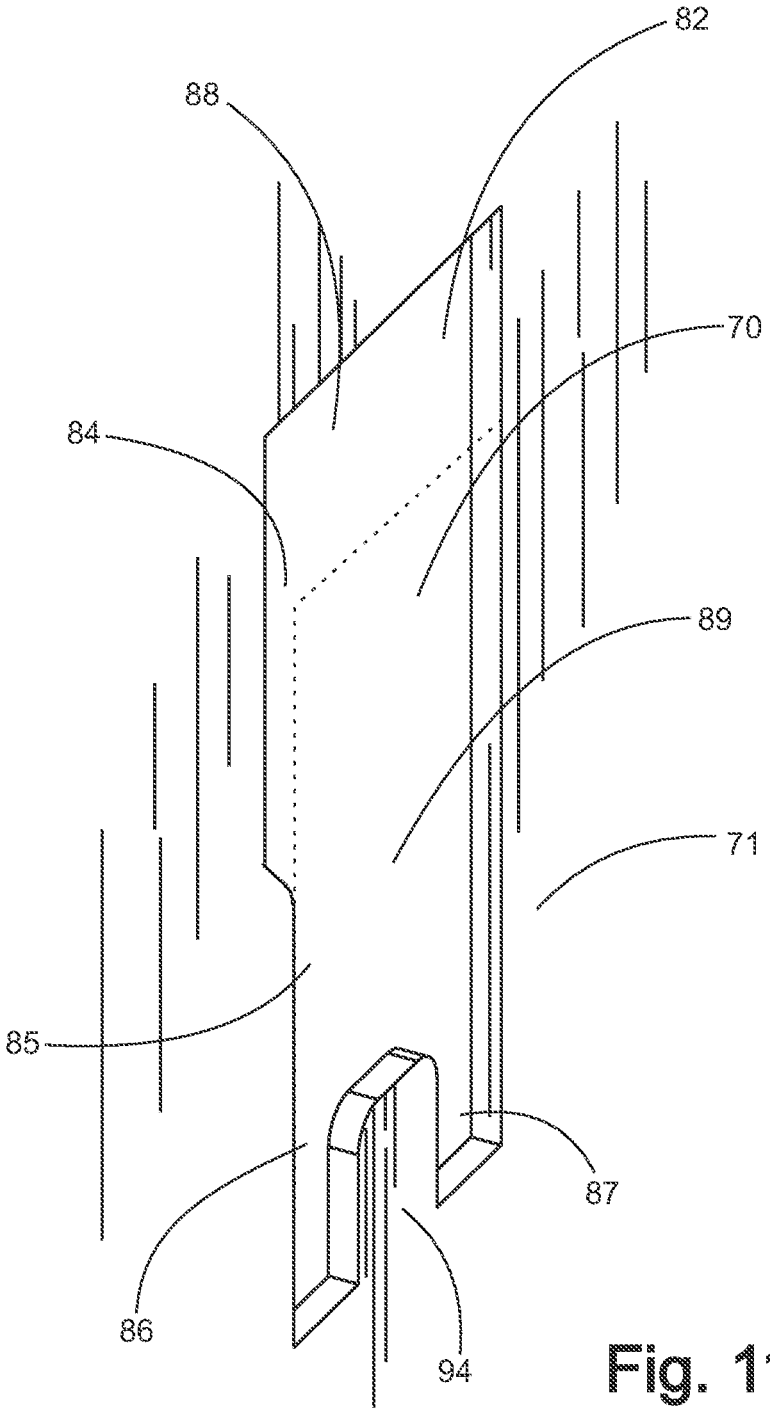
FIG. 11 is a close-up diagram showing the mounting aperture.

As seen in FIG. 11, the mounting aperture 82 has a plug area 88 and a crossbeam area 89. The plug 10 fits into the plug area 88, and the crossbeam 80 fits into the crossbeam area 89. The plug area 88 includes a wide portion 84. The crossbeam area 89 is formed on the horizontal frame member 70 and on the horizontal frame member inside side wall 71. The crossbeam area 89 has a narrow portion 85. The narrow portion 85 has a lower left channel 86 and the lower right channel 87. A mounting aperture lower protrusion 94 is formed between the lower right channel 87 and the lower left channel 86. The mounting aperture lower protrusion 94 fits into an opening on the cross beam 80 at a lower crossbeam opening 93. The lower crossbeam opening 93 is formed on a lower surface of the crossbeam 80 at an end of the crossbeam 80 at a left end and a right end of the crossbeam 80. Each crossbeam 80 has a pair of opposing lower crossbeam openings 93 that engage the left and right horizontal frame members respectively.

The invention claimed is:

1. A bed frame comprising:

a. a first horizontal frame member;

b. a second horizontal frame member, wherein the second horizontal frame member is parallel to the first horizontal frame member;

c. a crossbeam extending from the first horizontal frame member to the second horizontal frame member, wherein the crossbeam is inserted into the first horizontal frame member and the second horizontal frame member;

d. amounting aperture formed on the first horizontal frame member and receiving the crossbeam, wherein the mounting aperture has a wide portion above a narrow portion, wherein the wide portion includes a plug area, wherein the narrow portion includes a crossbeam area, wherein the crossbeam area receives the crossbeam;

e. a plug, wherein the plug area receives the plug, wherein the plug further includes a body insert having a rear panel opening formed as a general through the body insert, wherein the body insert is made of an elastomeric material, wherein the body insert further includes a body insert sloped upper side wall, wherein the sloped upper side wall further includes a body insert protrusion, wherein the body insert protrusion further includes a body insert protrusion engaging edge facing a front frame of the body insert to form a body insert flat upper wall for forming a front frame upper notch, wherein the front frame upper notch receives the horizontal frame member wherein the mounting aperture further includes a mounting aperture lower protrusion that inserts into a lower opening of the crossbeam.

2. The bed frame of claim 1, wherein the mounting aperture further includes a mounting aperture lower protrusion that inserts into a lower opening of the crossbeam.

3. The bed frame of claim 2, wherein the wide portion extends to a left or right side of the crossbeam area.

4. A bed frame comprising:

a. a first horizontal frame member;

b. a second horizontal frame member, wherein the second horizontal frame member is parallel to the first horizontal frame member;

c. a crossbeam extending from the first horizontal frame member to the second horizontal frame member, wherein the crossbeam is inserted into the first horizontal frame member and the second horizontal frame member;

d. a mounting aperture formed on the first horizontal frame member and receiving the crossbeam, wherein the mounting aperture has a wide portion above a narrow portion, wherein the wide portion includes a plug area, wherein the narrow portion includes a crossbeam area, wherein the crossbeam area receives the crossbeam; and e. a plug, wherein the plug area receives the plug, wherein the plug further includes a body insert, wherein the body insert protrudes into the first horizontal frame member, wherein the body insert further includes a downwardly extending side panel, wherein the downwardly extending side panel has a side panel rear edge, wherein the side panel rear edge also inserts into the first horizontal frame member, wherein the body insert forms a body insert lower wall that engages the crossbeam, wherein the body insert forms a body insert flat upper wall that engages the first horizontal frame member, wherein the downwardly extending side panel further includes a downwardly extending side panel inside wall that engages the crossbeam wherein the mounting aperture further includes a mounting aperture lower protrusion that inserts into a lower opening of the crossbeam.

5. The bed frame of claim 4, wherein the mounting aperture further includes a mounting aperture lower protrusion that inserts into a lower opening of the crossbeam.

6. The bed frame of claim 5, wherein the wide portion extends to a left or right side of the crossbeam area.

7. A bed frame comprising:

a. a first horizontal frame member;

b. a second horizontal frame member, wherein the second horizontal frame member is parallel to the first horizontal frame member;

c. a crossbeam extending from the first horizontal frame member to the second horizontal frame member, wherein the crossbeam is inserted into the first horizontal frame member and the second horizontal frame member;

d. a mounting aperture formed on the first horizontal frame member and receiving the crossbeam, wherein the mounting aperture has a wide portion above a narrow portion, wherein the wide portion includes a plug area, wherein the narrow portion includes a crossbeam area, wherein the crossbeam area receives the crossbeam; and e. a plug, wherein the plug area receives the plug, wherein the plug further includes a body insert, wherein the body insert further includes horizontal sloped section, wherein the horizontal slope section further includes a first flexible section and a second flexible section adjacent to the first flexible section, wherein the first flexible section and the second flexible section and bend downwardly when the plug is inserted into the horizontal frame member, when the horizontal frame member rides over a body insert protrusion to engage with a body insert flat upper wall and a body insert protrusion engaging edge wherein the mounting aperture further includes a mounting aperture lower protrusion that inserts into a lower opening of the crossbeam.

8. The bed frame of claim 7, wherein the mounting aperture further includes a mounting aperture lower protrusion that inserts into a lower opening of the crossbeam.

9. The bed frame of claim 8, wherein the wide portion extends to a left or right side of the crossbeam area.

* * * * *